US005408950A

United States Patent [19]

Porto

[11] Patent Number: 5,408,950

[45] Date of Patent: Apr. 25, 1995

[54] COMBINATION BOOKMARK DISPLAY DEVICE

[76] Inventor: Edson Porto, 66 Washington St., Wellesly, Mass. 02181

[21] Appl. No.: 62,587

[22] Filed: May 17, 1993

[51] Int. Cl.[6] ..... B42D 9/00

[52] U.S. Cl. ..... 116/239; 281/42

[58] Field of Search ..... 116/234, 238, 239, 235, 116/236, 237; 281/42

[56] References Cited

U.S. PATENT DOCUMENTS

| | | | |
|---|---|---|---|
| 761,556 | 5/1904 | Tack | 116/238 |
| 838,386 | 12/1906 | Crouch | 116/234 |
| 2,394,372 | 2/1946 | Evans | 116/238 X |
| 2,591,094 | 4/1952 | O'Neill | 116/234 X |
| 2,832,307 | 4/1958 | Cavalero | 116/238 |
| 2,911,940 | 11/1959 | Greider | 116/239 |
| 2,964,010 | 12/1960 | Harrison | 116/234 |
| 3,143,998 | 8/1964 | Madden | 116/238 |
| 4,437,685 | 3/1984 | Valencia | 116/234 |
| 4,448,310 | 5/1984 | Hodgson | 116/234 X |
| 4,574,721 | 3/1986 | Martin, Jr. | 116/234 |
| 5,103,758 | 4/1992 | Clark | 116/234 |

FOREIGN PATENT DOCUMENTS

| | | | |
|---|---|---|---|
| 2533168 | 3/1984 | France | 116/238 |
| 3202077 | 8/1983 | Germany | 116/239 |
| 0090393 | 4/1991 | Japan | 116/234 |
| 18966 | of 1891 | United Kingdom | 281/42 |
| 2223449 | 4/1990 | United Kingdom | 116/234 |

*Primary Examiner*—William A. Cuchlinski, Jr.
*Assistant Examiner*—Willie Morris Worth
*Attorney, Agent, or Firm*—John R. Flanagan

[57] ABSTRACT

A combination bookmark display device includes a head portion and a body portion connected to the head portion and having a plurality of elongated flexible marking elements adapted for placement longitudinally along the creases of different sections or pages of a book, magazine or bound stationary. The head portion includes a display head which has a pressure adhesive coating on a back surface thereof for adherence on a cover of the book. The head portion can be a folded display card or a business card. The display head can carry a message or a greeting. The marking elements can have different colors and lower end portions or tails with different labels printed thereon. Also, the marking elements can be detachably connected together and also are connected to the display mast by a neck comprised of a plurality of loose strings or braided or twisted strands.

6 Claims, 3 Drawing Sheets

COMBINATION BOOKMARK DISPLAY DEVICE

BACKGROUND OF THE INVENTION

1. Field of the Invention

The present invention generally relates to bookmarks and, more particularly, is concerned with a combination bookmark display device.

2. Description of the Prior Art

People use all kinds of cards carrying greetings and messages to say thanks, happy anniversary, congratulations, etc. These cards are typically enjoyed for a short period of time, after which they are thrown away. Tons of greeting cards are purchased and discarded every year.

Although many greeting cards contain good messages and evoke pleasant feelings and responses, most people find insufficient reason to retain most of these cards for an extended period of time. Quite possibly many persons would like to retain the messages of the cards for an extended period of time if they have another use.

However, other than as momentos of past occasions, these cards really serve no other useful purpose. It would be desirable to overcome this limitation of greeting cards by providing them with another utility which will provide benefits, in particular, to readers, researchers, teachers, students or anyone who uses books, magazines, notebooks or volumes of any bound stationary.

SUMMARY OF THE INVENTION

The present invention provides a combination bookmark display device designed to satisfy the aforementioned need. The combination bookmark display device includes a plurality of elongated marking elements for placement longitudinally along the creases of different sections or pages of a book or magazine. The bookmark display device also includes a display head supporting the marking elements. The display head is adapted to display messages, greetings, business logos and cards, photographs, etc., thereon. Also, the display head can have an adhesive coating applied on a back surface thereof for applying the display head to the cover of a book.

Accordingly, the present invention is directed to a bookmark display device which comprises: (a) a head portion including a display head having a surface for carrying a message thereon; and (b) a body portion connected to the head portion and having a plurality of elongated flexible marking elements adapted for placement longitudinally along the creases of different sections or pages of a book, magazine, notebook or any bound stationary. The head portion can also include a neck which connects the display head to the body portion. The display head has a pressure-sensitive adhesive coating on a back surface thereof for adherence on a cover of the book. As examples, the display head can take the form of a business card or a folded greeting card. The display head also carries the message or a greeting on a front surface thereof. The marking elements can have different colors and lower end portions or tails some with different labels printed thereon. Also, the marking elements can be detachably connected together and also are connected to the display head by a neck comprised of a plurality of loose strings or braided or twisted strands.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
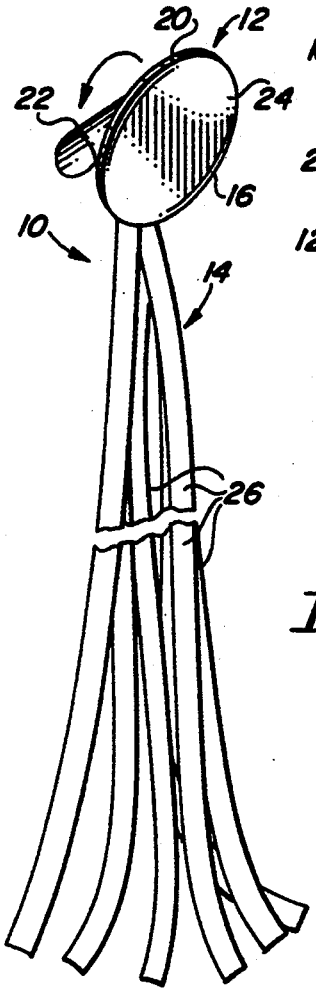
FIG. 1 is a front perspective view of a combination bookmark display device of the present invention.
Figure 2:
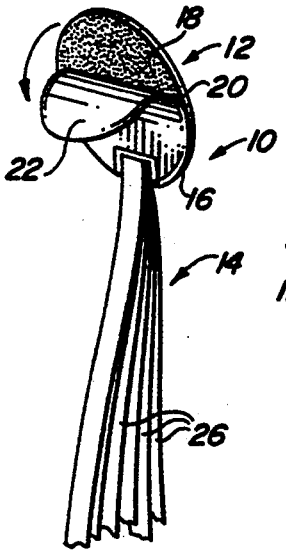
FIG. 2 is a fragmentary rear perspective view of the device of FIG. 1.

Referring to the drawings and particularly to FIGS. 1 and 2, there is illustrated an embodiment of a combination bookmark display device, generally designated 10, of the present invention. Basically, the bookmark display device 10 includes a head portion 12 and a body portion 14 connected to the head portion 12.

The head portion 12 of the device 10 includes a flat display head 16 having a pressure-sensitive adhesive coating 18 applied to some or all of the back surface 20 of the display head 16 thereof with a backing strip 22 thereon for covering and protecting the adhesive coating 18. A message or greeting or other indicia can be printed on the front surface 24 of the display head 16. The display head 16 can have many different shapes and can carry various items thereon, such as ornamental stones, jewelry, etc., when the display head 16 is to be mounted to the outside of the front cover of the book or magazine.

The body portion 14 of the device 10 includes a plurality of elongated flexible narrow marking elements 26 adapted for placement longitudinally along creases of different sections or pages of a book, magazine, notebook or any bound stationary. As examples, the marking elements 26 can be strips of ribbon or string made from any suitable material, such as paper, plastic, fabric, thread, metals, etc., which can be coated or embossed with a suitable metal, such as gold, silver, aluminum, etc.

Figure 3:
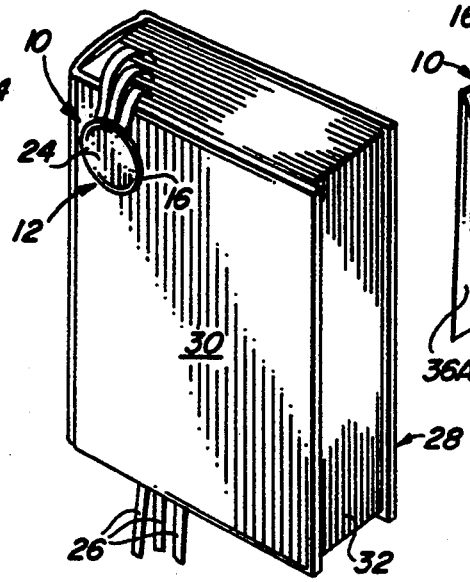
FIG. 3 is a perspective view of a book or volume of bound stationary in a closed condition with a display head of the bookmark display device mounted to the outside of the front cover of the book and some of a plurality of marking elements of the device marking different sections or pages.
Figure 4:
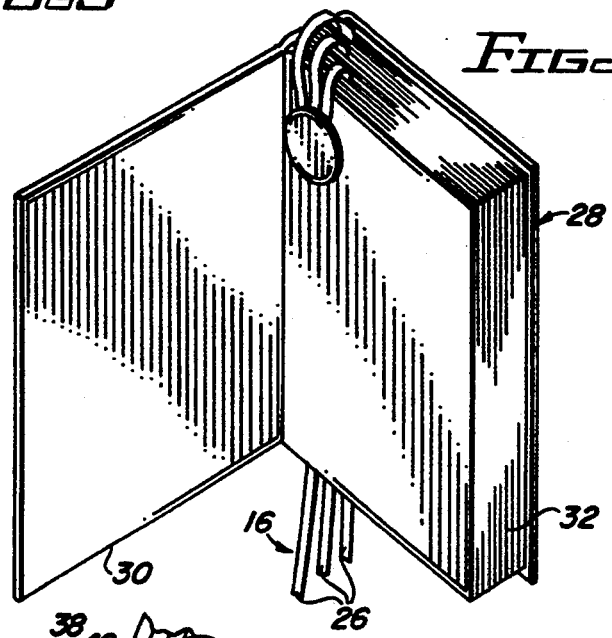
FIG. 4 is a perspective view similar to that of FIG. 3, but showing the display head of the bookmark display device mounted to the front page.

Referring to FIGS. 3 and 4, there is illustrated a book or a volume of bound stationary 28 with the display head 16 of the device 10 mounted thereto. In FIG. 3, the book 28 is shown in a closed condition with the display head 16 of the device 10 mounted to the outside of the front cover 30 of the book 28. Some of the marking elements 26 are deployed within the book 28 so as to mark different sections or pages 32 thereof. In FIG. 4, the book 28 is shown in an opened condition with the display head 16 of the device 10 mounted to the inside front page 32.

Figure 5:
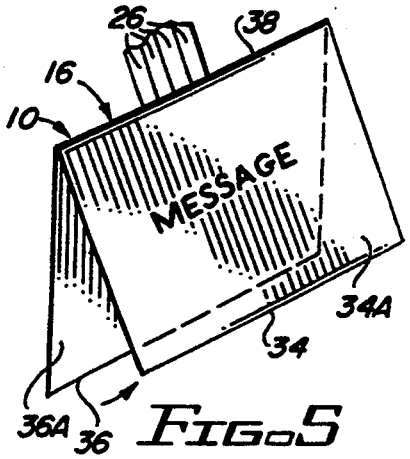
FIG. 5 is a fragmentary front perspective view of a bookmark display device having a folded display head.
Figure 6:
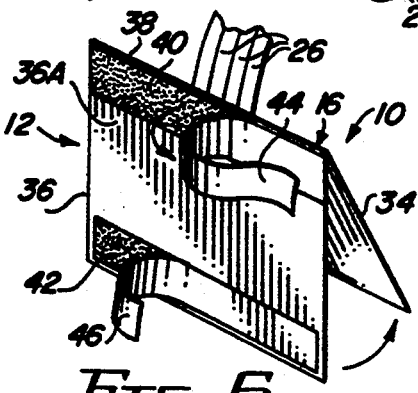
FIG. 6 is a fragmentary rear perspective view of the device of FIG. 5 showing backing strips partially removed from self-adhesive coatings applied on the back surface of the display head.
Figure 8:
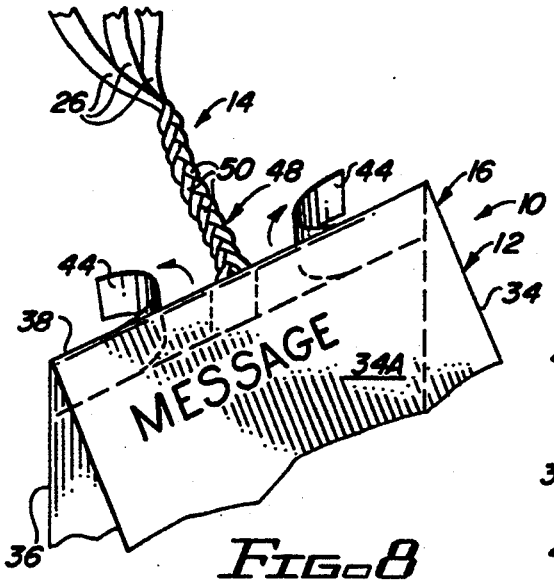
FIG. 8 is a fragmentary front perspective view of a combination bookmark display device having a folded display head and a plurality of marking elements connected to the display head by a braided or twisted neck.

Referring to FIGS. 5, 6 and 8, there is illustrated an embodiment of the device 10 in which the display head 16 is in the form of a folded sheet or card having front and back flaps 34, 36 connected together along upper fold line 38. The fold can either be at the top or the side of the card. In FIG. 5, the folded display head 16 has a message imprinted on a front surface 34A of the front flap 34. A message or greeting can be imprinted on a front surface 36A of the back flap 36 also. The marking elements 26 are attached at their one ends to the top edge of the card and thus supported from the back flap 36. In FIGS. 6 and 8 (and also FIG. 9), the folded display head has pressure-sensitive adhesive coatings 40, 42 applied along top and bottom portions of a back surface 36A of the back flap 36 with a pair of backing strips 44, 46 partially removed therefrom. The backing strips 44, 46 are shown partially removed from the self-adhesive coatings 40, 42 on the back surface 36A of the of back flap 36 of the display head 16.

Figure 7:
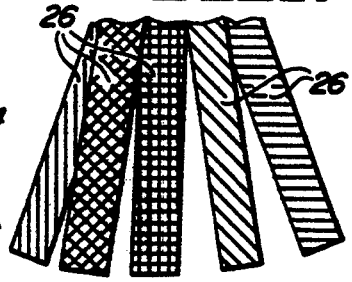
FIG. 7 is a fragmentary plan view of lower end portions of the marking elements of the bookmark display device being shaded to depict different colors of the marking elements.

As seen in FIG. 7, the marking elements 26 of the device 10 can have different colors. The marking elements 26 are shaded to depict different colors of the marking elements, such as red, orange, yellow, green and blue.

Figure 9:
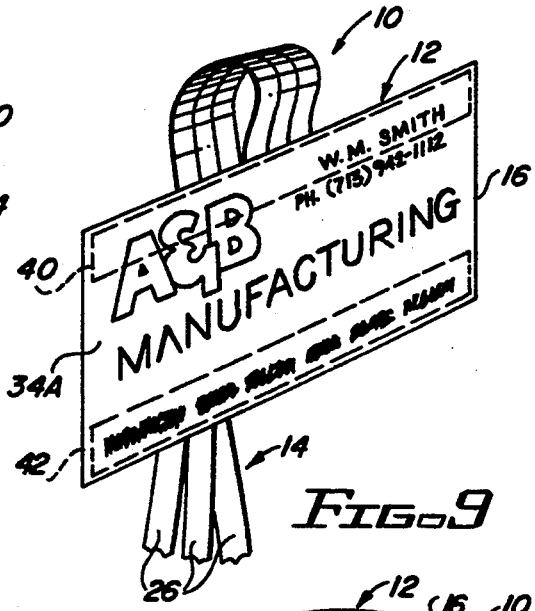
FIG. 9 is a fragmentary front perspective view of a combination bookmark display device having a display head in the form of a business card.

FIGS. 8–12 illustrate other features which can be incorporated by the combination bookmark display device 10 of the present invention. FIG. 8 illustrates an embodiment of the device 10 wherein the body portion 14 includes a neck 48 made of a plurality of strands 50 of material braided or twisted together and interconnecting the marking elements 26 to the back flap 36 of the folded display head 16. FIG. 9 shows an embodiment of the device 10 wherein the display head 16 is in the form of a business card.

Figure 10:
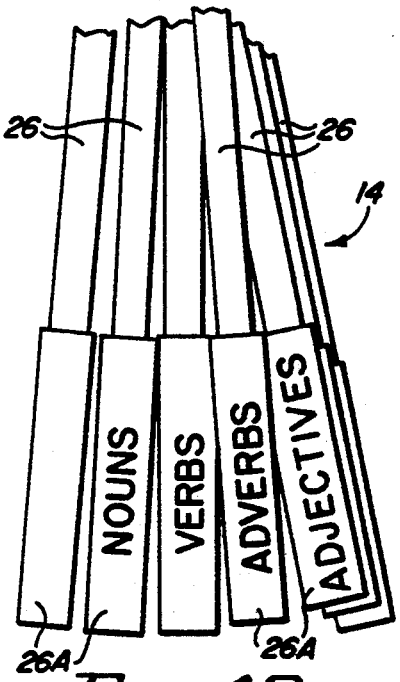
FIG. 10 is a fragmentary plan view of the lower end portions of the marking elements of the combination bookmark display device having different labels printed thereon.
Figure 11:
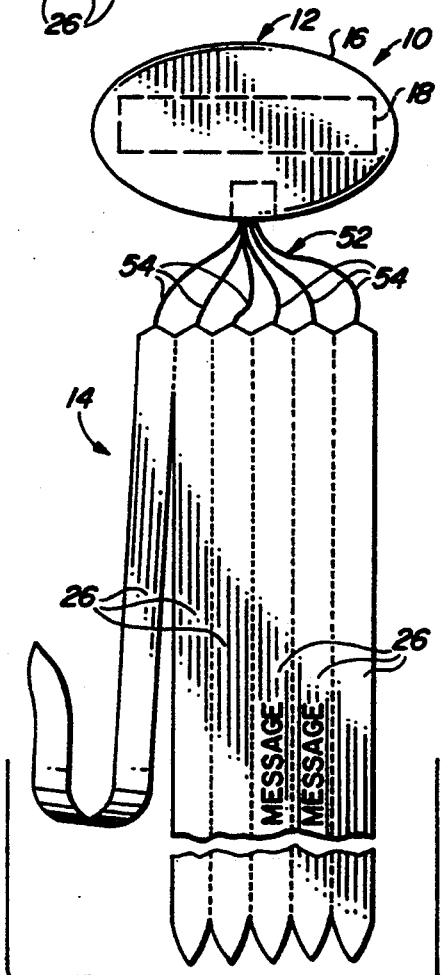
FIG. 11 is a front plan view of a combination bookmark display device having a display head and a plurality of marking elements detachably connected together and connected to the display head by a neck comprised of a plurality of strings.

FIG. 10 depicts an embodiment of the device 10 wherein some of the lower end or tail portions 26A of the marking elements 26 having different labels printed thereon. This embodiment is a design especially useful with notebooks, encyclopedias and dictionaries. FIG. 11 illustrates an embodiment of the device 10 wherein the marking elements 26 are detachably connected together and also are connected to the display head 16 by a neck 52 comprised of a plurality of strings 54. As seen in FIGS. 8 and 11, the plurality of flexible interconnecting members, whether the strands 50 of FIG. 8 or the strings 54 of FIG. 11, which form the neck 48, 52, are substantially shorter in length than the marking elements or strips 26.

Figure 12:
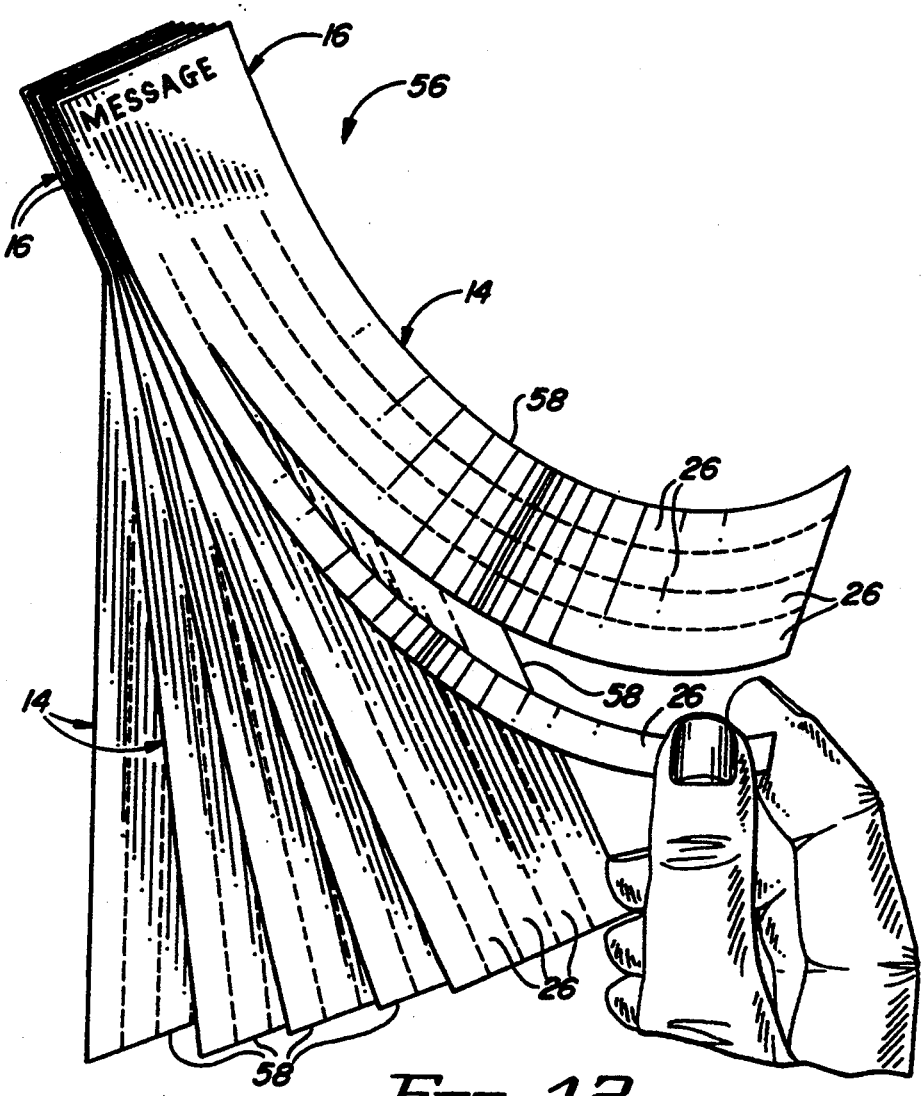
FIG. 12 is a perspective view of a pad of multiple elongated sheets each having a display head and a body portion merging from the display head and defining marking elements which are detachably connected together.

FIG. 12 shows a pad 56 which includes multiple elongated generally rectangular sheets 58. Each sheet 58 includes a display head 16 having an self-adhesive coating on a back side thereof for releasably assembling the sheets 58 into the pad 56 and a body portion 14 merging from the display head 16 and defining the marking elements 26 which are detachably connected together. One sheet 58 can be removed from the pad 56 as needed.

Figure 13:
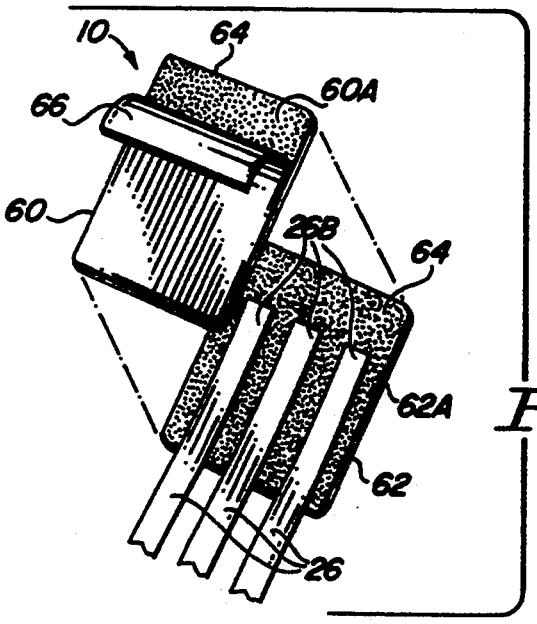
FIG. 13 is a disassembled view of another embodiment of the combination bookmark display device.

FIG. 13 shows another embodiment of the combination bookmark display device 10 in disassembled form. When assembled, the upper end portions 26B of the marking elements 26 are sandwiched between a pair of cards or sheets 60, 62 which have self-adhesive coatings 64 on at least one side 60A, 62A thereof. Peelable backing strips 66 cover the adhesive coating. The cards or sheets 60, 62 can be any one of various items, such as greeting cards, business cards, etc.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiments thereof.

I claim:

1. A combination bookmark display device, comprising:

(a) a display head having one surface for carrying a message thereon and another surface with an adhesive coating applied thereon for adherence on a cover of a book;

(b) a plurality of elongated flexible narrow page marking strips adapted for placement longitudinally along creases of different pages of a book or bound stationary; wherein said marking strips are detachably connected together along longitudinally extending side edges thereof; and (c) a non-marking neck in the form of a plurality of flexible members interconnecting said display head with individual ones of said page marking strips, said flexible interconnecting members of the non-marking neck being different in cross-sectional configuration and substantially shorter in length than said page marking strips.

2. The device of claim 1 wherein said display head is in the form of a folded display or greeting card.

3. The device of claim 1 wherein said display head is in the form of a business card.

4. The device of claim 1 wherein said marking strips have messages printed thereon.

5. The device of claim 1 wherein said flexible interconnecting members of said non-marking neck are loose strings.

6. The device of claim 1 wherein said flexible interconnecting members of said non-marking neck are braided or twisted strands.

* * * * *